US009356338B2

(12) United States Patent
Park

(10) Patent No.: US 9,356,338 B2
(45) Date of Patent: May 31, 2016

(54) ANTENNA APPARATUS AND FEEDING STRUCTURE THEREOF

(71) Applicant: Bum Ki Park, Seoul (KR)

(72) Inventor: Bum Ki Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 173 days.

(21) Appl. No.: 14/165,258

(22) Filed: Jan. 27, 2014

(65) Prior Publication Data

US 2014/0210679 A1 Jul. 31, 2014

(30) Foreign Application Priority Data

Jan. 25, 2013 (KR) ..... 10-2013-0008749

(51) Int. Cl.

| | |
|---|---|
| ***H01Q 9/00*** | (2006.01) |
| ***H01Q 1/24*** | (2006.01) |
| ***H01Q 9/42*** | (2006.01) |
| ***H01Q 5/328*** | (2015.01) |
| ***H01Q 5/335*** | (2015.01) |
| ***H01Q 5/357*** | (2015.01) |

(52) U.S. Cl.

CPC ..... *H01Q 1/243* (2013.01); *H01Q 5/328* (2015.01); *H01Q 5/335* (2015.01); *H01Q 5/357* (2015.01); *H01Q 9/42* (2013.01)

(58) Field of Classification Search

CPC ..... H01Q 1/246; H01Q 3/005
USPC ..... 343/745, 702, 860
See application file for complete search history.

(56) References Cited

U.S. PATENT DOCUMENTS

| | | | | |
|---|---|---|---|---|
| 6,297,776 | B1 * | 10/2001 | Pankinaho | H01Q 1/243 343/700 MS |
| 6,819,290 | B2 * | 11/2004 | Hani | H01Q 1/243 343/700 MS |
| 7,705,786 | B2 * | 4/2010 | Iellici | H01Q 1/243 343/700 MS |
| 8,022,888 | B2 * | 9/2011 | Kim | H01P 1/18 343/860 |
| 8,111,194 | B2 * | 2/2012 | Chang | H01Q 1/2283 343/700 MS |
| 8,164,524 | B2 * | 4/2012 | Tang | H01Q 5/364 343/700 MS |
| 2003/0142022 | A1 | 7/2003 | Ollikainen et al. | |
| 2009/0224996 | A1 * | 9/2009 | Kim | H01P 1/18 343/860 |
| 2011/0133994 | A1 * | 6/2011 | Korva | H01Q 1/243 343/702 |
| 2011/0148723 | A1 | 6/2011 | Bengtsson et al. | |
| 2011/0163934 | A1 * | 7/2011 | Tseng | H01Q 9/42 343/846 |
| 2012/0050121 | A1 | 3/2012 | Kim et al. | |
| 2012/0062434 | A1 * | 3/2012 | Kim | H01Q 9/42 343/749 |
| 2012/0262342 | A1 * | 10/2012 | Lee | H01Q 5/35 343/700 MS |
| 2013/0088399 | A1 | 4/2013 | Jeon et al. | |

FOREIGN PATENT DOCUMENTS

| | | |
|---|---|---|
| JP | 2006-054639 A | 2/2006 |
| JP | 2007-060349 A | 3/2007 |

(Continued)

OTHER PUBLICATIONS

European Search Report dated May 8, 2014 in European Application No. 14152617.8.

(Continued)

*Primary Examiner* — Jean B Jeanglaude
(74) *Attorney, Agent, or Firm* — Saliwanchik, Lloyd & Eisenschenk

(57) ABSTRACT

An antenna apparatus includes: a radiator; a feeding structure including a feeding unit to provide a signal to the radiator, a ground unit to ground the radiator, and a resonance applying part between the feeding unit and the ground unit; and a contact part to connect the radiator with the feeding structure.

14 Claims, 6 Drawing Sheets

(56) References Cited

FOREIGN PATENT DOCUMENTS

| | | | |
|---|---|---|---|
| JP | 2007-194995 | A | 8/2007 |
| JP | 2010-166287 | A | 7/2010 |
| JP | 2011-015034 | A | 1/2011 |
| KR | 10-2011-0112227 | A | 10/2011 |
| KR | 2011011227 | * | 10/2011 |
| WO | WO-2009/155966 | A1 | 12/2009 |

OTHER PUBLICATIONS

Notice of Allowance dated Jan. 28, 2014 in Korean Application No. 10-2013-0008749.

* cited by examiner

ANTENNA APPARATUS AND FEEDING STRUCTURE THEREOF

CROSS-REFERENCE TO RELATED APPLICATION

This application claims the benefit under 35 U.S.C. §119 of Korean Patent Application No. 10-2013-0008749, filed Jan. 25, 2013, which is hereby incorporated by reference in its entirety.

BACKGROUND

The embodiment relates to a configuration of a communication terminal, and more particularly, to an antenna apparatus and a feeding structure thereof.

Generally, a communication terminal includes an antenna apparatus to transmit/receive an electromagnetic wave. The antenna apparatus resonates at a specific frequency band to transmit/receive an electromagnetic wave having a corresponding frequency band. In this case, when the antenna apparatus resonates at the corresponding frequency band, impedance has an imaginary number. Further, an S parameter with respect to the antenna apparatus is rapidly reduced at the corresponding frequency band.

In this regard, the antenna apparatus includes a conducting wire having an electric length of $\lambda/2$ with respect to a wavelength $\lambda$ corresponding to the desired frequency band. The antenna apparatus transmits the electromagnetic wave through the conducting wire and the electromagnetic wave forms a standing wave in the conducting wire so that resonance is achieved in the antenna apparatus. In this case, the antenna apparatus may include a plurality of conductive waves having mutually different lengths to expand a resonance frequency band.

However, since an electric length of the conducting wire in the above antenna apparatus is determined depending on a resonance frequency band, the size of the antenna apparatus is determined depending on the resonance frequency band. Accordingly, as a resonance frequency band to be realized is gradually reduced in the antenna apparatus, the size of the antenna apparatus becomes enlarged. The above problem may become serious as the number of conducting wires in the antenna apparatus is increased. That is, as the resonance frequency band is expanded in the antenna apparatus, the size of the antenna apparatus may become enlarged.

BRIEF SUMMARY

The embodiment provides an antenna apparatus capable of easily adjusting a resonance frequency band. That is, the embodiment provides an antenna apparatus capable of adjusting the resonance frequency band without increasing the size of the antenna apparatus.

According to the embodiment, there is provided an antenna apparatus including: a radiator; a feeding structure including a feeding unit to provide a signal to the radiator, a ground unit to ground the radiator, and a resonance applying part between the feeding unit and the ground unit; and a contact part to connect the radiator with the feeding structure.

The contact part may adjust a resonance frequency band determined in the feeding structure according to at least one of a location and a size of the contact part in the feeding structure.

The contact part may include: a first contact unit in the feeding unit; and a second contact unit in one of the ground unit and the resonance applying part.

The second contact unit may be disposed in the resonance applying part, and the feeding unit and the resonance applying part are open from each other.

The second contact unit may be disposed in the ground unit, and the resonance applying part and the ground unit may be open from each other.

The contact part may further include a third contact unit disposed in another of the ground unit and the resonance applying part.

The feeding unit and the resonance applying part may be open from each other, and the resonance applying part and the ground unit may be open from each other.

According to the embodiment, there is provided a feeding structure including: a resonance part configured by connecting a ground unit with a feeding unit to feed a signal toward the ground unit; a resonance applying part between the feeding unit and the ground unit; and a contact part in at least one of the resonance part and the resonance applying part.

The contact part may adjust a resonance frequency band determined in the resonance part and the resonance applying part according to at least one of a location and a size of the contact part.

The contact part may include: a first contact unit in the feeding unit; and a second contact unit in one of the ground unit and the resonance applying part.

The second contact unit may be disposed in the resonance applying part and the feeding unit and the resonance applying part may be open from each other, or the second contact unit may be disposed in the ground unit and the resonance applying part and the ground unit may be open from each other.

The contact part may further include a third contact unit disposed in another of the ground unit and the resonance applying part.

The feeding unit and the resonance applying part may be open from each other and the resonance applying part and the ground unit may be open from each other.

According to the antenna apparatus and a feeding structure thereof of the embodiment, a resonance frequency band of the antenna apparatus may be easily adjusted. That is, the antenna apparatus may include the resonance applying part so that the antenna apparatus may be operated at a plurality of resonance bands. Further, the antenna apparatus includes a reactance element so that at least one of the resonance bands can be easily adjusted. In addition, the antenna apparatus may include the contact part to easily adjust at least one of the resonance bands. In this case, since at least one of the resonance bands is adjusted according to at least one of a location and a size of the contact part, a space in the antenna apparatus can be efficiently used. Accordingly, the resonance frequency band of the antenna apparatus can be adjusted without increasing the size of the antenna apparatus.

DETAILED DESCRIPTION

Figure 1:
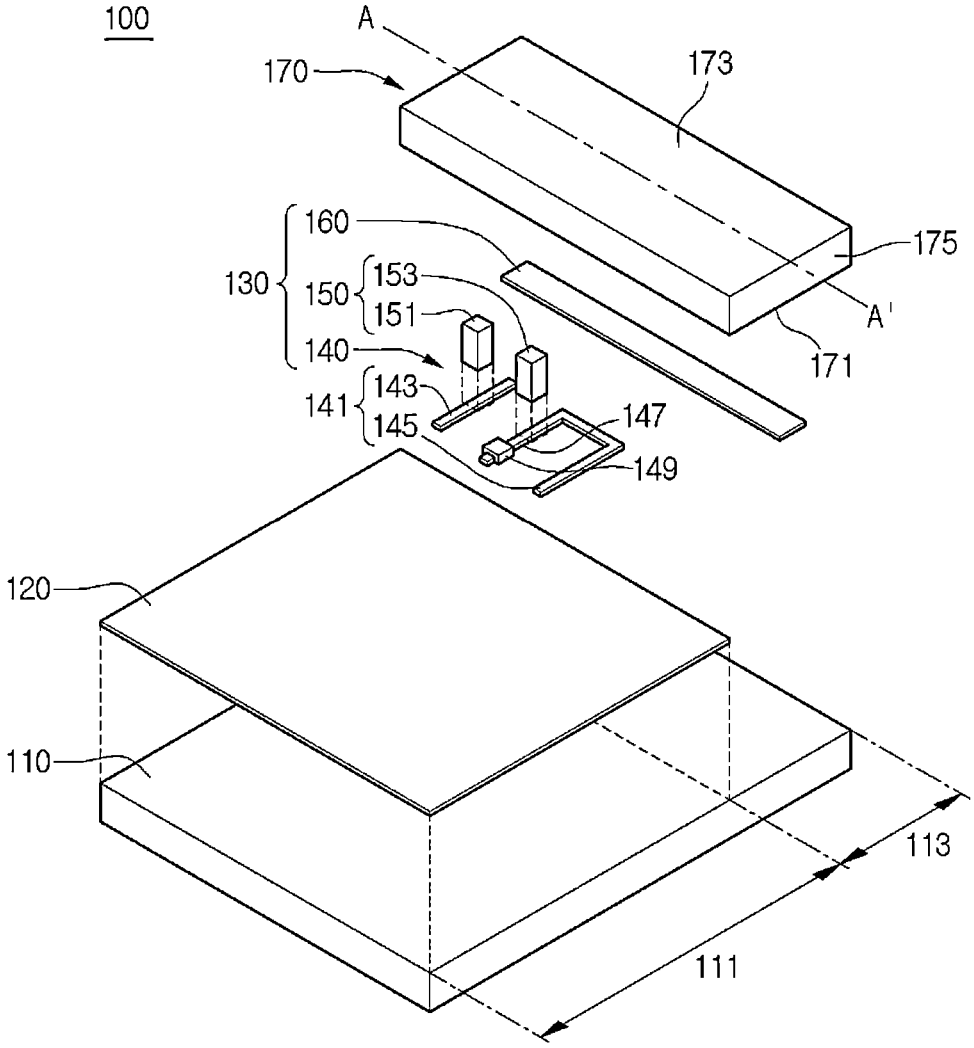
FIG. 1 is an exploded perspective view illustrating an antenna apparatus according to a first embodiment.

Hereinafter, the embodiment will be described with reference to accompanying drawings in detail. In the following description, for the illustrative purpose, the same components will be assigned with the same reference numerals, and the repetition in the description about the same components will be omitted in order to avoid redundancy. Detailed descriptions of well-known functions and structures may be omitted to avoid obscuring the subject matter of the disclosure.

Figure 2:
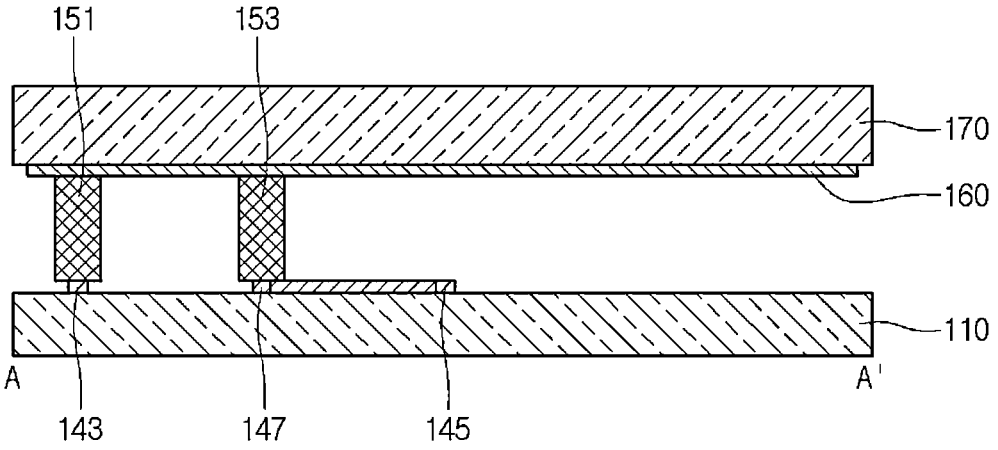
FIG. 2 is a sectional view taken along line A-A' of FIG. 1.
Figure 3:
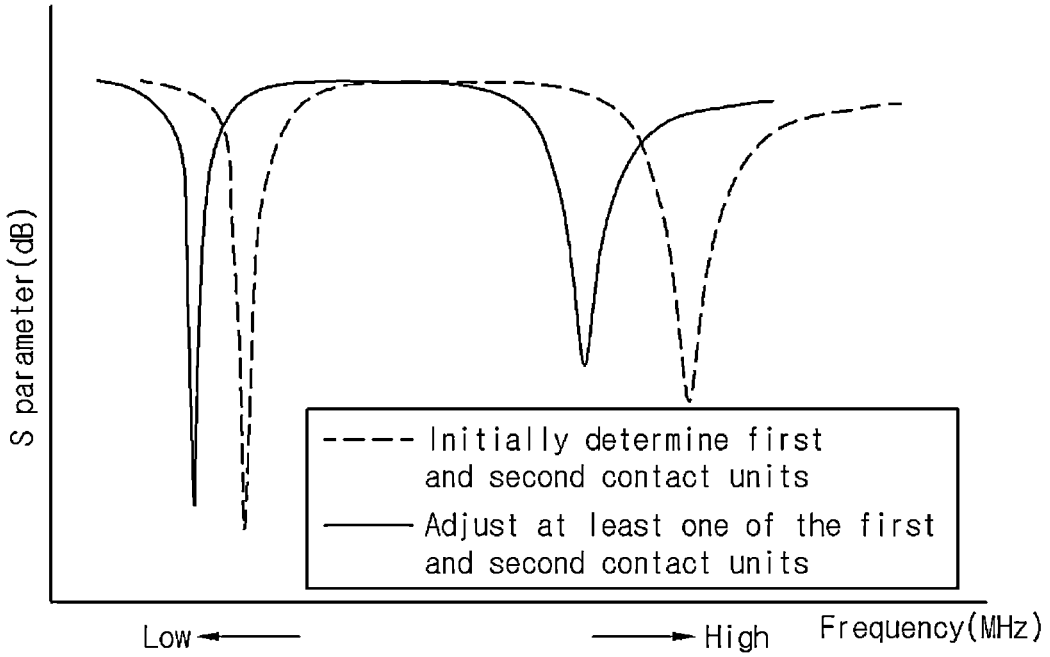
FIG. 3 is a graph illustrating operation characteristics of the antenna apparatus according to a first embodiment.

FIG. 1 is an exploded perspective view illustrating an antenna apparatus according to a first embodiment. FIG. 2 is a sectional view taken along line A-A' of FIG. 1. FIG. 3 is a graph illustrating operation characteristics of the antenna apparatus according to a first embodiment.

Referring to FIGS. 1 and 2, the antenna apparatus 100 according to the embodiment include a drive substrate 110, a ground member 120, an antenna element 130, and a mounting member 170.

The drive substrate 110 serves as a power feeder and a supporter in the antenna apparatus 100. In this case, the drive substrate 110 may include a printed circuit board (PCB). The drive substrate 110 has a flat plate structure. The drive substrate 110 may be prepared as a single substrate, and may be prepared by laminating a plurality of substrates.

The drive substrate 110 is divided into a ground region 117 and a resonance region 119. Further, a transmission line (not shown) is embedded in the drive substrate 110. The transmission line is connected to a control module (not shown) through one end thereof. In addition, the transmission line is exposed to the resonance region 113 through an opposite end thereof. That is, the transmission line receives a signal from the control module to transfer the signal from one end thereof to an opposite end thereof.

Further, the drive substrate 110 includes a dielectric substance. The drive substrate 110 may include a dielectric substance having conductivity $\sigma$ of 0.02. Moreover, the drive substrate 110 may include a dielectric substance having permittivity $\in$ of 4.4. In addition, the drive substrate 110 may include a dielectric substance having loss tangent of 0.02. In this case, the transmission line may include a conductive material. The transmission line may include at least one of silver (Ag), palladium (Pd), platinum (Pt), copper (Cu), gold (Au), and nickel (Ni).

The ground member 120 of the antenna apparatus 100 is provided for grounding. The ground member 120 is mounted on the drive substrate 110. In this case, the ground member 120 is disposed in the ground region 111. In this case, the ground member 120 may be disposed in at least one of a top surface and a bottom surface of the drive substrate 110. When the drive substrate 110 includes a plurality of substrates, the ground member 120 may be disposed between the substrates. Further, the ground member 120 may have a flat plate structure. The ground member 120 may fully cover the ground region 111. The ground member 120 may partially cover the ground region 111.

The antenna element 130 is provided to transmit/receive a signal in the antenna apparatus 100. In this case, the antenna element 130 transmits/receives a signal at a resonance frequency band. That is, the antenna element 130 operates at a resonance frequency band to transmit/receive an electromagnetic wave. When a signal from the drive substrate 110 is supplied to the antenna element 130, the antenna element 130 may operate. In addition, the antenna element 130 resonates at preset impedance.

In this case, the resonance frequency band of the antenna element 130 includes a plurality of resonance bands. That is, the resonance frequency band includes a first resonance band and a second resonance band. The first resonance band may have a lower frequency as compared with a frequency of the second resonance band. That is, the second resonance band may have a higher frequency as compared with a frequency of the first resonance band. The first resonance band is separated from the second resonance band based on the frequency. Accordingly, the resonance frequency band of the antenna element 130 may be a multi-frequency band. The first resonance band is coupled with the second resonance band based on the frequency. Accordingly, the resonance frequency band of the antenna element 130 may be a wide frequency band.

The antenna element 130 is mounted on the drive substrate 110. In this case, the antenna element 130 is disposed in the resonance region 113. The antenna element 130 may be disposed on the top surface of the drive substrate 110. The antenna element 130 makes contact with the transmission line in the resonance region 113. Further, the antenna element 130 makes contact with the ground member 120. The antenna element 130 includes a feeding structure 140, a contact part 150, and a radiator 160.

The feeding structure 140 is provided to feed power to the antenna element 130. That is, the feeding structure 140 operates the radiator 160. Further, the feeding structure 140 operates together with the radiator 160. In this case, the feeding structure 140 provides a signal to the radiator 160. In addition, the feeding structure 140 allows the signal to be transferred from the radiator 160. The feeding structure 140 includes a resonance part 141, a resonance applying part 147, and a reactance element 149.

The resonance part 141 determines a first resonance band in the resonance frequency band of the antenna element 130. The resonance part 141 makes contact with a transmission line in the resonance region 113. Further, the resonance part 141 makes contact with the ground member 120. The resonance part 141 includes a feeding unit 143 and a ground unit 145.

The feeding unit 143 provides a signal to the radiator 160. The feeding part 143 makes contact with a transmission line of the drive substrate 110. In this case, the feeding unit 143 makes contact with the transmission line of the drive substrate 110 through one end thereof. The one end of the feeding unit 143 is defined as a feeding point FP. For example, the feeding point FP may make contact with the transmission line at a location close to the ground member 120. In other words, the feeding point does not make contact with the ground member 120. Further, the feeding unit 143 extends from the transmission line. In this case, the feeding unit 143 extends through an opposite end thereof. The feeding unit 143 is open at the opposite end thereof. Accordingly, the feeding unit 143 provides a signal to the radiator 160 from the one end thereof to the opposite end thereof. In this case, the feeding unit 143 includes a conductive material. The feeding unit 143 may include at least one of silver (Ag), palladium (Pd), platinum (Pt), copper (Cu), gold (Au), and nickel (Ni).

The ground unit 145 grounds the radiator 160. The ground unit 145 makes contact with the ground member 120. In this case, the ground unit 145 makes contact with the ground member 120 through one end thereof. The one end of the ground unit 145 is defined as a ground point. Further, the ground unit 145 extends from the ground member 120. In this case, the ground part 145 extends through an opposite end thereof. Accordingly, the ground unit 145 transfers the signal toward the ground member 120 from the opposite end thereof to the one end thereof. In addition, the ground unit 145 includes a conductive material. The ground unit 145 may include at least one of silver (Ag), palladium (Pd), platinum (Pt), copper (Cu), gold (Au), and nickel (Ni).

The resonance applying part 147 applies a second resonance band to the resonance frequency band of the antenna element 130. That is, the resonance applying part 147 determines a second resonance band in the resonance frequency band of the antenna element 130. The resonance applying part 147 is disposed between the feeding unit 143 and the ground unit 145 of the resonance part 141. In this case, the resonance applying part 147 is open from the feeding unit 143. Further, the resonance applying part 147 is connected to the ground unit 145. That is, the feeding unit 143 and the resonance applying part 147 are open from each other, and the feeding unit 143 and the ground unit 145 are open from each other. Accordingly, the signal from the resonance part 141 is introduced into the resonance applying part 147.

Further, the resonance applying part 147 is connected to the ground member 120. In this case, the resonance applying part 147 is connected to the ground member 120 through one end thereof. The resonance applying part 147 may make contact with the ground member 120 through the one end thereof. In addition, the resonance applying part 147 extends from the ground member 120. In this case, the resonance applying part 147 extends from the ground member 120 through an opposite end thereof. The resonance applying part 147 is connected to the ground unit 145 through the opposite end thereof. Accordingly, the resonance applying part 147 is grounded from the opposite end to the one end.

In addition, the resonance applying part 147 includes a conductive material. The resonance applying part 147 may include at least one of silver (Ag), palladium (Pd), platinum (Pt), copper (Cu), gold (Au), and nickel (Ni).

The reactance element 149 is provided to adjust the resonance frequency band in the antenna element 130. That is, the reactance element 149 adjusts electric characteristics of the antenna element 130. In this case, the reactance element 149 has preset reactance. That is, the reactance element 149 adjusts the electric characteristics of the antenna element 130 according to reactance. Further, the reactance element 149 includes at least one of a capacitive element and an inductive element. The capacitive element may include a capacitor and the inductive element may include an inductor. The reactance element 149 is disposed in the resonance applying part 147.

The contact part 150 is provided to connect the feeding structure 140 with the radiator 160 in the antenna element 130. That is, the contact part 150 is interposed between the feeding structure 140 and the radiator 160. In this case, the contact part 150 protrudes from a plane on which the feeding structure 140 is disposed. That is, the contact part 150 extends from the feeding structure 140 to the radiator 160. The contact part 150 makes contact with the feeding structure 140 through one end thereof. Further, the contract part 150 extends from an opposite end thereof. Further, the contact part 150 makes contact with the radiator 160 through the opposite end thereof.

In addition, the contact part 150 operates together with the feeding structure and the radiator 160. In this case, the contact part 150 transfers a signal from the feeding structure 140 to the radiator 160. Further, the contact part 150 adjusts the resonance frequency band in the antenna element 130. That is, the contact part 150 adjusts electric characteristics of the antenna element 130. In this case, the contact part 150 has a preset size, that is, a length and a sectional area. The length of the contact part 150 is determined in a direction extending from the feeding structure 140 to the radiator 160. In addition, the sectional area of the contact part 150 is determined in perpendicular to the direction extending from the feeding structure 140 to the radiator 160. In other words, the contact part 150 adjusts the electric characteristics of the antenna element 130 according to the length and the sectional area thereof.

The contact part 150 is disposed in the resonance part 141 and the resonance applying part 147. In this case, the contact part 150 includes a first contact unit 151 and a second contact unit 153. The first contact unit 151 is disposed in the resonance part 141. The first contact unit 151 is disposed in the feeding unit 143. That is, the first contact unit 151 is interposed between a feeding point of the feeding unit 143 and the resonance applying part 147. The second contact unit 153 is disposed in the resonance applying part 147. The second contact unit 153 may be interposed between the resonance part 141 and the reactance element 149 in the resonance applying part 147. Although not shown in drawings, the second contact unit 153 may be interposed between the ground member 120 and the reactance element 149 in the resonance applying part 147. Although not shown in drawings, the contact part 150 includes a plurality of second contact units 153 so that the second contact units 153 may be disposed at both ends of the reactance element 149 in the resonance applying part 147.

In addition, the contact part 150 includes a conductive material. The contact part 150 may include at least one of silver (Ag), palladium (Pd), platinum (Pt), copper (Cu), gold (Au), and nickel (Ni). Further, the contact part 150 may be prepared in the form of a pin. Otherwise, the contact part 150 may be prepared in the form of a C-clip.

The radiator 160 is provided to substantially operate the antenna element 130. In this case, if a signal from the feeding structure 140 is provided to the radiator 160, the radiator 160 operates at a resonance frequency band. At this time, the radiator 160 operates together with the ground member 120, the feeding structure 140, and the contact part 150. The radiator 160 makes contact with the contact part 150. The radiator 160 makes contact with an opposite end of the contact part 150. Further, the radiator 160 is connected to the feeding structure 140 through the contact part 150. In this case, the radiator 160 is connected to the resonance part 141 and the resonance applying part 147. In addition, the radiator 160 includes a conductive material. The radiator 160 may include at least one of silver (Ag), palladium (Pd), platinum (Pt), copper (Cu), gold (Au), and nickel (Ni).

The mounting member 170 is provided to support the radiator 160 in the antenna apparatus 100. That is, as the radiator 160 is mounted on the mounting member 170, the mounting member 170 support the radiator 160. In this case, although not shown in drawings, when the antenna apparatus 100 is mounted on a communication terminal (not shown), the mounting member 170 may be mounted on an inner surface of an external case in the communication terminal. The drive substrate 110 may be disposed in an inner space defined by the external case in the communication terminal.

The mounting member 170 is disposed corresponding to the drive substrate 110. The mounting member 170 is disposed corresponding to the resonance region 113 of the drive substrate 110. Further, the mounting member 170 is spaced apart from the drive substrate 110 or the feeding structure 140 through the contact part 150. In addition, the mounting member 170 includes a bottom surface 171, a top surface 173 corresponding to the bottom surface 171, and a lateral side 175 to connect the bottom surface 171 with the top surface 173. The mounting member 170 may be mounted on the external case of the communication terminal through the top surface 173 thereof.

In this case, the radiator 160 may be mounted on the bottom surface 171 of the mounting member 170. Although not shown in drawings, the radiator 160 may be mounted on the top surface 173 of the mounting member 170. The radiator 160 may be interposed between the external case of the communication terminal and the mounting member 170. Further, the radiator 160 may extend to the bottom surface 171 along the lateral side 175 of the mounting member 170. Meanwhile, the radiator 160 may extend to the bottom surface 171 thereof by passing through the mounting member 170. Accordingly, the radiator 160 may make contact with the contact part 150.

Accordingly, the feeding structure 140, the contact part 150, and the radiator 160 are operated together. In this case, if a signal from the drive substrate 110 is applied, the signal is transferred to the feeding structure 140. Further, the signal from the feeding structure 140 is provided to the radiator 160. The feeding unit 143 transfers a signal to the first contact unit 151, and the first contact unit 151 transfers the signal to the radiator 160. In addition, the signal is transferred from the radiator 160 to the feeding structure 140. The radiator 160 transfers the signal to the second contact unit 153, and the second contact unit 153 transfers the signal to the ground unit 145 and the resonance applying part 147. Accordingly, two resonance loops, that is, a first resonance loop and a second resonance loop are formed in the antenna element 130.

The first resonance loop is formed by the resonance part 141 and the contact part 150. That is, the first resonance loop includes the feeding unit 143, the ground unit 145, the first contact unit 151, and the second contact unit 153. In addition, the first resonance loop determines a first resonance band in the resonance frequency band of the antenna element 130. In this case, the first resonance band is determined according to a size of the first resonance loop. The size of the first resonance loop is determined according to the size of the feeding unit 143, the size of the ground unit 145, locations and sizes of the first contact unit 151 and the second contact unit 153 in the feeding structure 140. Accordingly, the first resonance band may be adjusted according to an interval between the first contact unit 151 and the second contact unit 153 or at least one of lengths and sectional areas of the first contact unit 151 and the second contact unit 153.

The second resonance loop is formed by the ground unit 145, the resonance applying part 147, the reactance element 149, and the second contact unit 153. That is, the second resonance loop includes the ground unit 145, the resonance applying part 147, the reactance element 149, and the second contact unit 153. In addition, the second resonance loop determines a second resonance band in the resonance frequency band of the antenna element 130. In this case, the second resonance band is determined according to a size of the second resonance loop and reactance of the reactance element 149. The size of the second resonance loop is determined according to the size of the ground unit 145, the size of the resonance applying part 147, and the locations and the size of the second contact unit 153. Accordingly, the second resonance band may be adjusted according to a length and a sectional area of the second contact unit 153.

Accordingly, the antenna apparatus 100 operates at a preset resonance frequency band. For example, the antenna apparatus 100 may have operation characteristics as shown in FIG. 3. That is, the antenna apparatus 100 resonates at the first resonance band by the first resonance loop. The first resonance band is determined by the first resonance loop. Further, the antenna apparatus 100 resonates at the second resonance band by the second resonance loop. The second resonance band is determined by the second resonance loop. In this case, locations and sizes of the first contact unit 151 and the second contact unit 153 are initially determined so that the first resonance band and the second resonance band are determined.

Further, if at least one of the location and the size of the contact part 150 are adjusted, at least one of the first resonance band and the second resonance band may be adjusted. In this case, if an interval between the first contact unit 151 and the second contact unit 153 is adjusted, at least one of the first resonance band and the second resonance band may be adjusted. Further, if the lengths and the sectional areas of the first contact unit 151 and the second contact unit 153 are adjusted, at least one of the first resonance band and the second resonance band may be adjusted. That is, at least one of the first resonance band and the second resonance band may be adjusted while maintaining an operation performance of the antenna apparatus 100. At least one of the first resonance band and the second resonance band may be adjusted to have a lower frequency band or a higher frequency band.

Figure 4:
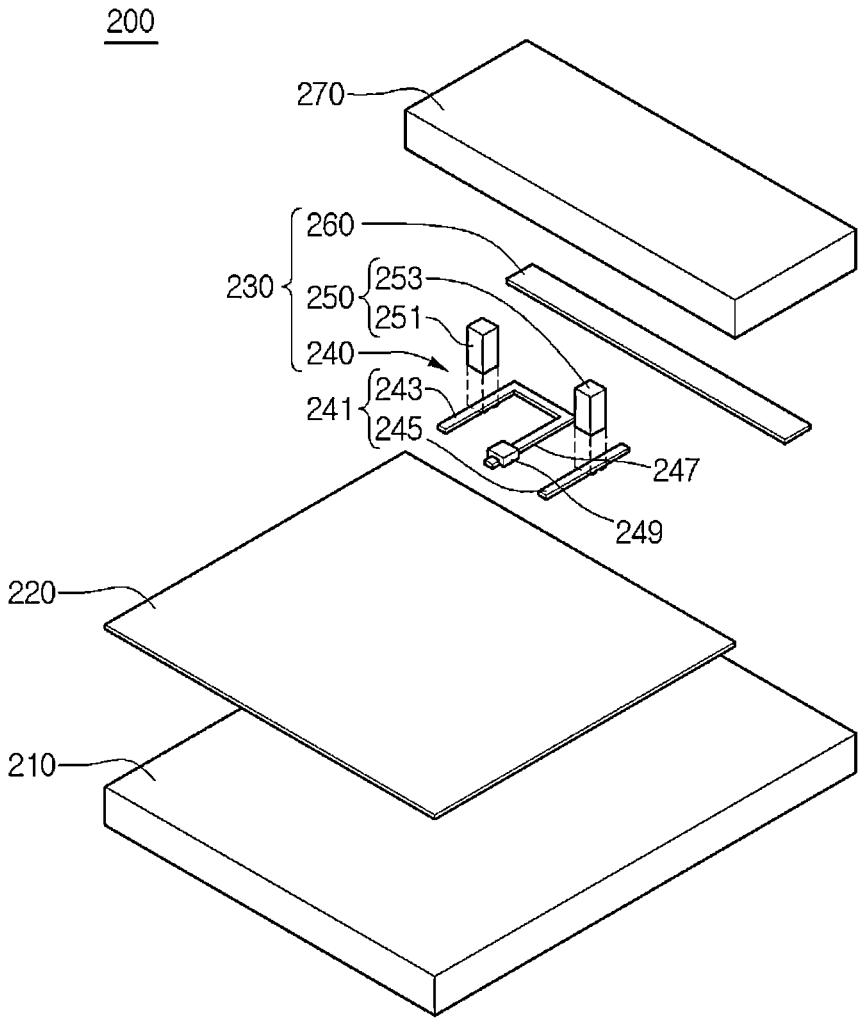
FIG. 4 is an exploded perspective view illustrating an antenna apparatus according to a second embodiment.

FIG. 4 is an exploded perspective view illustrating an antenna apparatus according to a second embodiment.

Referring to FIG. 4, the antenna apparatus 200 according to the second embodiment includes a drive substrate 210, a ground member 220, an antenna element 230, and a mounting member 270. Further, the antenna element 230 includes a feeding structure 240, a contact part 250, and a radiator 260. Moreover, the feeding structure 240 includes a resonance part 241, a resonance applying part 247, and a reactance element 249. In addition, the resonance part 241 includes a feeding unit 243 and a ground unit 245. In this case, since respective configurations of the second embodiment are similar to those of the first embodiment, a detailed description thereof is omitted.

However, in the antenna apparatus 200 according to the second embodiment, the feeding unit 243 is connected to the resonance applying part 247. That is, the feeding unit 243 and the resonance applying part 247 are not open from each other. An opposite end of the feeding unit 243 is connected to an opposite end of the resonance applying part 247. In contrast, the ground unit 245 and the resonance applying part 247 are open from each other. The ground unit 245 is open at an opposite end thereof. That is, the feeding unit 243 and the ground unit 245 are open from each other, and the ground unit 245 and the resonance applying part 247 are open from each other.

Further, the reactance element 249 is disposed in the resonance applying part 247. The reactance element 249 adjusts a resonance frequency band in the antenna element 230. That is, the reactance element 249 adjusts electric characteristics of the antenna element 230. In this case, the reactance element 249 has preset reactance. That is, the reactance element 249 adjusts the electric characteristics of the antenna element 230. Further, the reactance element 249 includes at least one of a capacitive element and an inductive element. The capacitive element may include a capacitor and the inductive element may include an inductor.

In addition, the contact part 250 is disposed in the resonance part 241. That is, the contact part 250 is not disposed in the resonance applying part 247. In this case, the contact part 250 includes a first contact unit 251 and a second contact unit 253. The first contact unit 251 and the second contact unit 253 are individually disposed in the resonance part 241. The first contact unit 251 is disposed in the feeding unit 243. Further, the second contact unit 253 is disposed in the ground unit 245.

That is, the second contact unit 253 is interposed between the resonance applying part 247 and a ground point of the ground unit 245.

Accordingly, the feeding structure 240, the contact part 250, and the radiator 260 are operated together. That is, two resonance loops, that is, a first resonance loop and a second resonance loop are formed in the antenna element 230.

The first resonance loop is formed by the resonance part 241 and the contact part 250. That is, the first resonance loop includes the feeding unit 243, the ground unit 245, the first contact unit 251, and the second contact unit 253. In addition, the first resonance loop determines a first resonance band in the resonance frequency band of the antenna element 230. In this case, the first resonance band is determined according to a size of the first resonance loop. The size of the first resonance loop is determined according to the size of the feeding unit 243, the size of the ground unit 245, locations and sizes of the first contact unit 251 and the second contact unit 253 in the feeding structure 240. Accordingly, the first resonance band may be adjusted according to an interval between the first contact unit 251 and the second contact unit 253 or at least one of lengths and sectional areas of the first contact unit 251 and the second contact unit 253.

The second resonance loop is formed by the ground unit 245, the resonance applying part 247, the reactance element 249, and the second contact unit 253. That is, the second resonance loop includes the ground unit 245, the resonance applying part 247, the reactance element 249, and the second contact unit 253. In addition, the second resonance loop determines a second resonance band as the resonance frequency band of the antenna element 230. In this case, the second resonance band is determined according to a size of the second resonance loop and reactance of the reactance element 249. The size of the second resonance loop is determined according to the size of the ground unit 245, the size of the resonance applying part 247, and the location and the size of the second contact unit 253. Accordingly, the second resonance band may be adjusted according to a length and a sectional area of the second contact unit 253.

Accordingly, the antenna apparatus 200 operates at a preset resonance frequency band. That is, the antenna apparatus 200 resonates at the first resonance band by the first resonance loop. The first resonance band is determined by the first resonance loop. Further, the antenna apparatus 200 resonates at the second resonance band by the second resonance loop. The second resonance band is determined by the second resonance loop. In this case, locations and sizes of the first contact unit 251 and the second contact unit 253 are initially determined so that the first resonance band and the second resonance band are determined.

Further, if at least one of the location and the size of the contact part 250 are adjusted, at least one of the first resonance band and the second resonance band may be adjusted. In this case, if an interval between the first contact unit 251 and the second contact unit 253 is adjusted, at least one of the first resonance band and the second resonance band may be adjusted. Further, if the lengths and the sectional areas of the first contact unit 251 and the second contact unit 253 are adjusted, at least one of the first resonance band and the second resonance band may be adjusted. That is, at least one of the first resonance band and the second resonance band may be adjusted while maintaining an operation performance of the antenna apparatus 200. At least one of the first resonance band and the second resonance band may be adjusted to have a lower frequency band or a higher frequency band.

Figure 5:
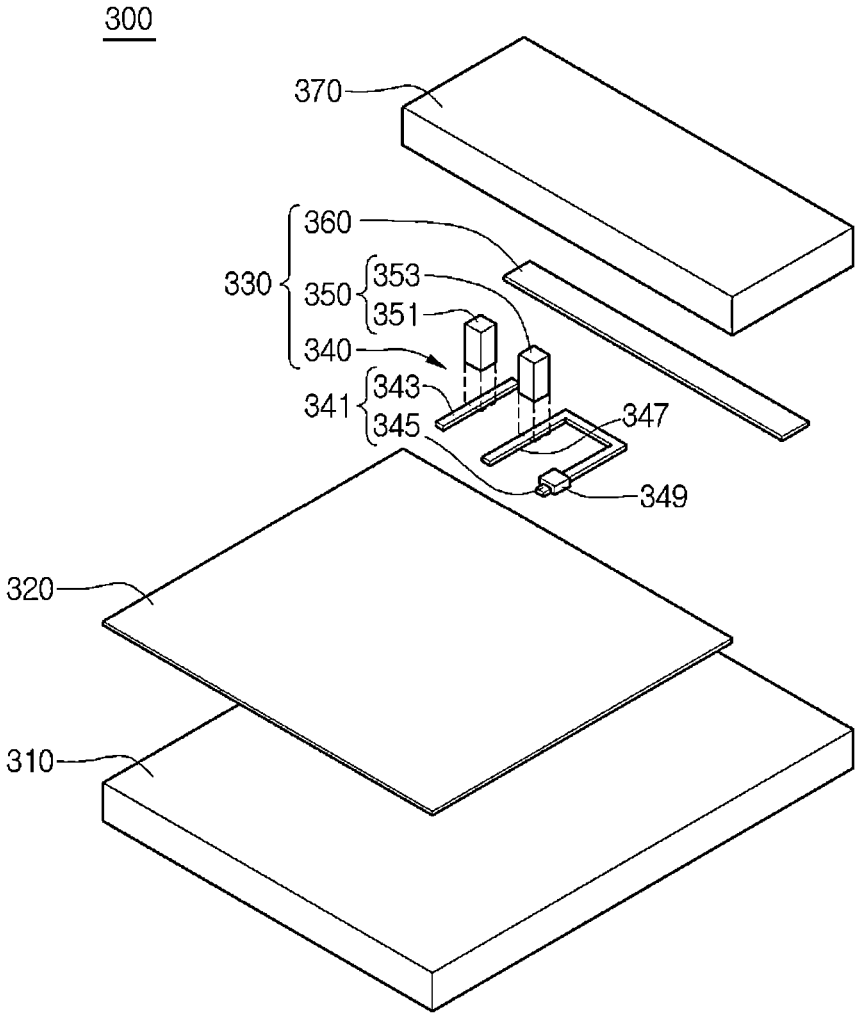
FIG. 5 is an exploded perspective view illustrating an antenna apparatus according to a third embodiment.

FIG. 5 is an exploded perspective view illustrating an antenna apparatus according to a third embodiment.

Referring to FIG. 5, the antenna apparatus 300 according to the third embodiment includes a drive substrate 310, a ground member 320, an antenna element 330, and a mounting member 370. Further, the antenna element 330 includes a feeding structure 340, a contact part 350, and a radiator 360. Moreover, the feeding structure 340 includes a resonance part 341, a resonance applying part 347, and a reactance element 349. In addition, the resonance part 341 includes a feeding unit 343 and a ground unit 345. In this case, since respective configurations of the third embodiment are similar to those of the above embodiment, a detailed description thereof is omitted.

However, in the antenna apparatus 300 according to the embodiment, the feeding unit 343 and the resonance applying part 347 are open from each other. The feeding unit 343 is open at an opposite end thereof. Further, the ground unit 345 is connected to the resonance applying part 347. That is, the ground unit 345 and the resonance applying part 347 are not open from each other. An opposite end of the ground unit 345 is connected to an opposite end of the resonance applying part 347. That is, the feeding unit 343 and the resonance applying part 347 are open from each other, and the feeding unit 343 and the ground unit 345 are open from each other.

Further, the reactance element 349 is disposed in the ground unit 345. That is, the reactance element 349 is interposed between the resonance applying part 347 and a ground point of the ground unit 345. The reactance element 249 adjusts a resonance frequency band in the antenna element 230. That is, the reactance element 349 adjusts electric characteristics of the antenna element 330. In this case, the reactance element 349 has preset reactance. That is, the reactance element 349 adjusts the electric characteristics of the antenna element 330. Further, the reactance element 349 includes at least one of a capacitive element and an inductive element. The capacitive element may include a capacitor and the inductive element may include an inductor.

In addition, the contact part 350 is disposed in the resonance part 341 and the resonance applying part 347. In this case, the contact part 350 includes a first contact unit 351 and a second contact unit 353. The first contact unit 351 is disposed in the resonance part 341. The first contact unit 351 is disposed in the feeding unit 343. That is, the first contact unit 351 is interposed between a feeding point of the feeding unit 343 and the resonance applying part 347.

Accordingly, the feeding structure 340, the contact part 350, and the radiator 360 are operated together. That is, two resonance loops, that is, a first resonance loop and a second resonance loop are formed in the antenna element 330.

The first resonance loop is formed by the resonance part 341, the reactance element 349, and the contact part 350. That is, the first resonance loop includes the feeding unit 343, the ground unit 345, the reactance element 349, the first contact unit 351, and the second contact unit 353. In addition, the first resonance loop determines a first resonance band in the resonance frequency band of the antenna element 330. In this case, the first resonance band is determined according to a size of the first resonance loop and reactance of the reactance element 349. The size of the first resonance loop is determined according to the size of the feeding unit 343, the size of the ground unit 345, locations and sizes of the first contact unit 351 and the second contact unit 353 in the feeding structure 340. Accordingly, the first resonance band may be adjusted according to an interval between the first contact unit 351 and the second contact unit 353 or at least one of lengths and sectional areas of the first contact unit 351 and the second contact unit 353.

The second resonance loop is formed by the ground unit 345, the resonance applying part 347, the reactance element 349, and the second contact unit 353. That is, the second resonance loop includes the ground unit 345, the resonance applying part 347, the reactance element 349, and the second contact unit 353. In addition, the second resonance loop determines a second resonance band in the resonance frequency band of the antenna element 330. In this case, the second resonance band is determined according to a size of the second resonance loop and reactance of the reactance element 349. The size of the second resonance loop is determined according to the size of the ground unit 345, the size of the resonance applying part 347, and the location and the size of the second contact unit 353. Accordingly, the second resonance band may be adjusted according to a length and a sectional area of the second contact unit 353.

Accordingly, the antenna apparatus 300 operates at a preset resonance frequency band. That is, the antenna apparatus 200 resonates at the first resonance band by the first resonance loop. The first resonance band is determined by the first resonance loop. Further, the antenna apparatus 300 resonates at the second resonance band by the second resonance loop. The second resonance band is determined by the second resonance loop. In this case, locations and sizes of the first contact unit 351 and the second contact unit 353 are initially determined so that the first resonance band and the second resonance band are determined.

Further, if at least one of the location and the size of the contact part 350 are adjusted, at least one of the first resonance band and the second resonance band may be adjusted. In this case, if an interval between the first contact unit 351 and the second contact unit 353 is adjusted, at least one of the first resonance band and the second resonance band may be adjusted. Further, if the lengths and the sectional areas of the first contact unit 351 and the second contact unit 353 are adjusted, at least one of the first resonance band and the second resonance band may be adjusted. That is, at least one of the first resonance band and the second resonance band may be adjusted while maintaining an operation performance of the antenna apparatus 300. At least one of the first resonance band and the second resonance band may be adjusted to have a lower frequency band or a higher frequency band.

Figure 6:
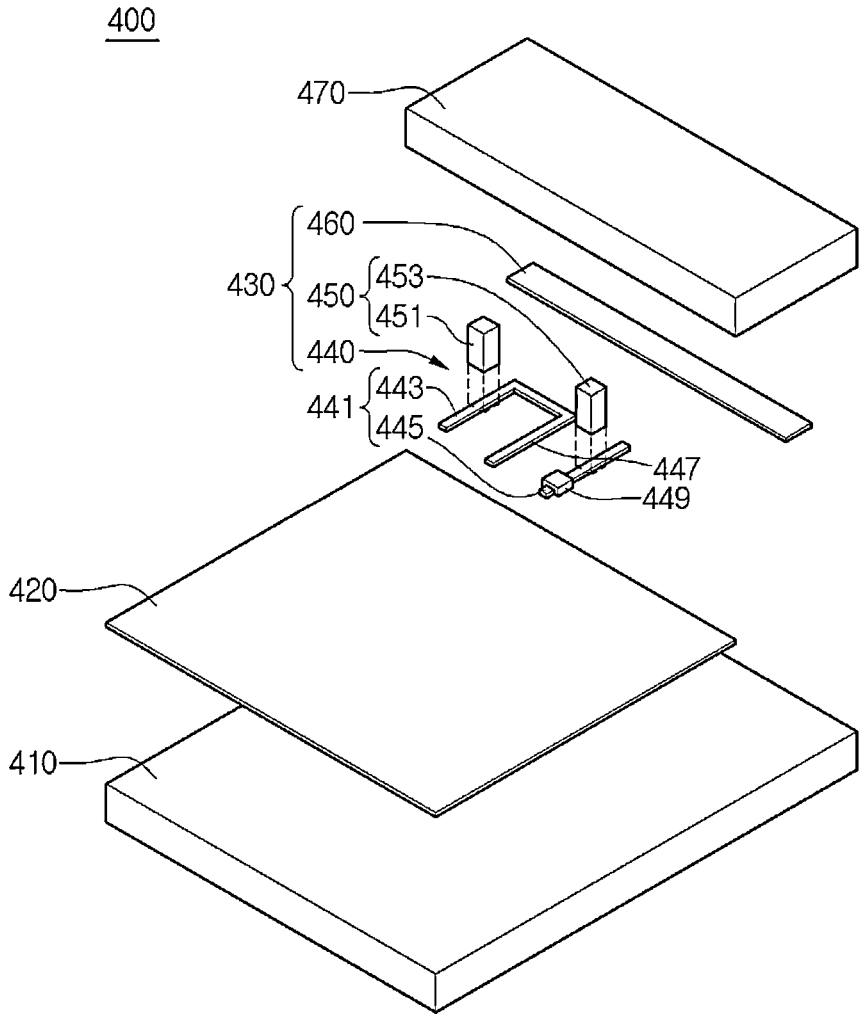
FIG. 6 is an exploded perspective view illustrating an antenna apparatus according to a fourth embodiment.

FIG. 6 is an exploded perspective view illustrating an antenna apparatus according to a fourth embodiment.

Referring to FIG. 6, the antenna apparatus 400 according to the fourth embodiment includes a drive substrate 410, a ground member 420, an antenna element 430, and a mounting member 470. Further, the antenna element 430 includes a feeding structure 440, a contact part 450, and a radiator 460. Moreover, the feeding structure 440 includes a resonance part 441, a resonance applying part 447, and a reactance element 449. In addition, the resonance part 441 includes a feeding unit 443 and a ground unit 445. In this case, since respective configurations of the second embodiment are similar to those of the above embodiment, a detailed description thereof is omitted.

However, in the antenna apparatus 400 according to the fourth embodiment, the feeding unit 443 is connected to the resonance applying part 447. That is, the feeding unit 443 and the resonance applying part 447 are not open from each other. An opposite end of the feeding unit 443 is connected to an opposite end of the resonance applying part 447. In contrast, the ground unit 445 and the resonance applying part 447 are open from each other. The ground unit 445 is open at an opposite end thereof. That is, the feeding unit 443 and the ground unit 445 are open from each other, and the ground unit 445 and the resonance applying part 447 are open from each other.

Further, the reactance element 449 is disposed in the ground unit 445. That is, the reactance element 449 is interposed between the resonance applying part 447 and a ground point of the ground unit 445. The reactance element 449 adjusts a resonance frequency band in the antenna element 430. That is, the reactance element 449 adjusts electric characteristics of the antenna element 430. In this case, the reactance element 449 has preset reactance. That is, the reactance element 449 adjusts the electric characteristics of the antenna element 430. Further, the reactance element 449 includes at least one of a capacitive element and an inductive element. The capacitive element may include a capacitor and the inductive element may include an inductor.

In addition, the contact part 450 is disposed in the resonance part 441. That is, the contact part 450 is disposed in the resonance applying part 447. In this case, the contact part 450 includes a first contact unit 451 and a second contact unit 453. The first contact unit 451 and the second contact unit 453 are individually disposed. The first contact unit 451 is disposed in the feeding unit 443. Further, the second contact unit 453 is disposed in the ground unit 445. For example, the second contact unit 453 may be interposed between the resonance applying part 447 and the reactance element 449 in the ground unit 445. Although not shown in drawings, the second contact unit 453 may be interposed between the ground member 420 and the reactance element 449 in the ground unit 445. Although not shown in drawings, the contact part 450 includes a plurality of second contact units 453 so that the second contact units 453 may be disposed at both ends of the reactance element 449 in the ground unit 445.

Accordingly, the feeding structure 440, the contact part 450, and the radiator 460 are operated together. That is, two resonance loops, that is, a first resonance loop and a second resonance loop are formed in the antenna element 430.

The first resonance loop is formed by the resonance part 441, the reactance element 449, and the contact part 450. That is, the first resonance loop includes the feeding unit 443, the ground unit 445, the reactance element 449, the first contact unit 451, and the second contact unit 453. In addition, the first resonance loop determines a first resonance band as the resonance frequency band of the antenna element 430. In this case, the first resonance band is determined according to a size of the first resonance loop and reactance of the reactance element 449. The size of the first resonance loop is determined according to the size of the feeding unit 443, the size of the ground unit 445, locations and sizes of the first contact unit 451 and the second contact unit 453 in the feeding structure 440. Accordingly, the first resonance band may be adjusted according to an interval between the first contact unit 451 and the second contact unit 453 or at least one of lengths and sectional areas of the first contact unit 451 and the second contact unit 453.

The second resonance loop is formed by the ground unit 445, the resonance applying part 447, the reactance element 449, and the second contact unit 453. That is, the second resonance loop includes the ground unit 445, the resonance applying part 447, the reactance element 449, and the second contact unit 453. In addition, the second resonance loop determines a second resonance band in the resonance frequency band of the antenna element 430. In this case, the second resonance band is determined according to a size of the second resonance loop and reactance of the reactance element 449. The size of the second resonance loop is determined according to the size of the ground unit 445, the size of the resonance applying part 447, and the location and the size of the second contact unit 453. Accordingly, the second resonance band may be adjusted according to a length and a sectional area of the second contact unit 453.

Accordingly, the antenna apparatus 200 operates at a preset resonance frequency band. That is, the antenna apparatus 400 resonates at the first resonance band by the first resonance loop. The first resonance band is determined by the first resonance loop. Further, the antenna apparatus 400 resonates at the second resonance band by the second resonance loop. The second resonance band is determined by the second resonance loop. In this case, locations and sizes of the first contact unit 451 and the second contact unit 453 are initially determined so that the first resonance band and the second resonance band are determined.

Further, if at least one of the location and the size of the contact part 450 are adjusted, at least one of the first resonance band and the second resonance band may be adjusted. In this case, if an interval between the first contact unit 451 and the second contact unit 453 is adjusted, at least one of the first resonance band and the second resonance band may be adjusted. Further, if the lengths and the sectional areas of the first contact unit 451 and the second contact unit 453 are adjusted, at least one of the first resonance band and the second resonance band may be adjusted. That is, at least one of the first resonance band and the second resonance band may be adjusted while maintaining an operation performance of the antenna apparatus 400. At least one of the first resonance band and the second resonance band may be adjusted to have a lower frequency band or a higher frequency band.

Figure 7:
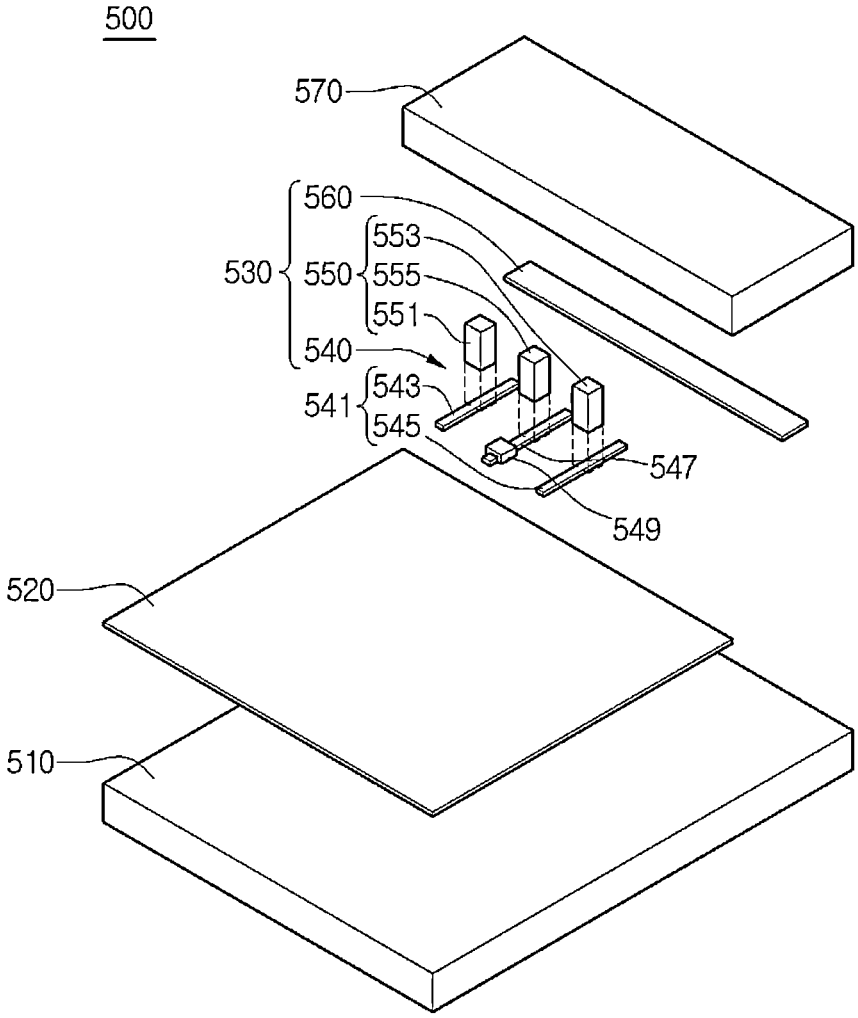
FIG. 7 is an exploded perspective view illustrating an antenna apparatus according to a fifth embodiment.

FIG. 7 is an exploded perspective view illustrating an antenna apparatus according to a fifth embodiment.

Referring to FIG. 7, the antenna apparatus 500 according to the fifth embodiment includes a drive substrate 510, a ground member 520, an antenna element 530, and a mounting member 570. Further, the antenna element 530 includes a feeding structure 540, a contact part 550, and a radiator 560. Moreover, the feeding structure 540 includes a resonance part 541, a resonance applying part 547, and a reactance element 549. In addition, the resonance part 541 includes a feeding unit 543 and a ground unit 545. In this case, since respective configurations of the second embodiment are similar to those of the above embodiment, a detailed description thereof is omitted.

However, in the antenna apparatus 500 according to the fifth embodiment, the feeding unit 543 and the resonance applying part 547 are open from each other. Further, the ground unit 545 and the resonance applying part 547 are open from each other. In addition, the feeding unit 543 and the ground unit 545 are open from each other. The feeding unit 543, the ground unit 545, and the resonance applying part 547 are individually open at opposite ends thereof, respectively.

Further, the reactance element 549 is disposed in the resonance applying part 547. The reactance element 549 adjusts a resonance frequency band in the antenna element 530. That is, the reactance element 549 adjusts electric characteristics of the antenna element 530. In this case, the reactance element 549 has preset reactance. That is, the reactance element 549 adjusts the electric characteristics of the antenna element 530 according to reactance thereof. Further, the reactance element 549 includes at least one of a capacitive element and an inductive element. The capacitive element may include a capacitor and the inductive element may include an inductor.

In addition, the contact part 550 is disposed in the resonance part 541 and the resonance applying part 547. In this case, the contact part 550 includes a first contact unit 551, a second contact unit 553, and a third contact unit 555. The first contact unit 551 is disposed in the feeding unit 543. That is, the first contact unit 551 is disposed between a feeding point of the feeding unit 543 and the resonance applying part 547. Further, the second contact unit 553 is disposed in the ground unit 545, and the third contact unit 555 is disposed in the resonance applying part 547.

Accordingly, the feeding structure 540, the contact part 550, and the radiator 560 are operated together. That is, two resonance loops, that is, a first resonance loop and a second resonance loop are formed in the antenna element 530.

The first resonance loop is formed by the resonance part 541, the first contact unit 551, and the second contact part 553. That is, the first resonance loop includes the feeding unit 543, the ground unit 545, the first contact unit 551, and the second contact unit 553. In addition, the first resonance loop determines a first resonance band as the resonance frequency band of the antenna element 530. In this case, the first resonance band is determined according to a size of the first resonance loop. The size of the first resonance loop is determined according to the size of the feeding unit 543, the size of the ground unit 545, locations and sizes of the first contact unit 551 and the second contact unit 553 in the feeding structure 540. Accordingly, the first resonance band may be adjusted according to an interval between the first contact unit 551 and the second contact unit 553 or at least one of lengths and sectional areas of the first contact unit 551 and the second contact unit 553.

The second resonance loop is formed by the ground unit 545, the resonance applying part 547, the reactance element 549, the second contact unit 553, and the third contact unit 555. That is, the second resonance loop includes the ground unit 545, the resonance applying part 547, the reactance element 549, the second contact unit 553, and the third contact unit 555. In addition, the second resonance loop determines a second resonance band as the resonance frequency band of the antenna element 530. In this case, the second resonance band is determined according to a size of the second resonance loop and a reactance length and a sectional area of the reactance element 549. The size of the second resonance loop is determined according to the size of the ground unit 545, the size of the resonance applying part 447, and the locations and the sizes of the second contact unit 553 and the third contact unit 555. Accordingly, the second resonance band may be adjusted according to an interval between the second contact unit 553 and the third contact unit 555 or at least one of a length and a sectional area of the second contact unit 553 and the second contact unit 555.

Accordingly, the antenna apparatus 500 operates at a preset resonance frequency band. That is, the antenna apparatus 500 resonates at the first resonance band by the first resonance loop. The first resonance band is determined by the first resonance loop. Further, the antenna apparatus 500 resonates at the second resonance band by the second resonance loop. The second resonance band is determined by the second resonance loop. In this case, locations and sizes of the first contact unit 551, the second contact unit 553, and the third contact unit 555 are initially determined so that the first resonance band and the second resonance band are determined.

Further, if at least one of the location and the size of the contact part 550 are adjusted, at least one of the first resonance band and the second resonance band may be adjusted. In this case, if an interval between the first contact unit 551 and the second contact unit 553 is adjusted, the first resonance band may be adjusted. Further, if lengths and sectional areas of the first contact unit 551 and the second contact unit 553 are adjusted, the first resonance band may be adjusted. Meanwhile, if an interval between the second contact unit 553 and the third contact unit 555 is adjusted, the second resonance band may be adjusted. In addition, if lengths and sectional areas of the second contact unit 553 and the third contact unit 555 are adjusted, the second resonance band may be adjusted. That is, at least one of the first resonance band and the second resonance band may be adjusted while maintaining an operation performance of the antenna apparatus 500. At least one of the first resonance band and the second resonance band may be adjusted to have a lower frequency band or a higher frequency band.

According to the embodiments, the resonance frequency bands of the antenna apparatuses 100, 200, 300, 400, and 500 may be easily adjusted. That is, the antenna apparatuses 100, 200, 300, 400, and 500 may include the resonance applying parts 147, 247, 347, 447, and 547 to be operated at a plurality of resonance bands. Further, the antenna apparatuses 100, 200, 300, 400, and 500 may include the reactance elements 149, 249, 349, 449, and 549 to easily adjust at least one of the resonance bands. In addition, the antenna apparatuses 100, 200, 300, 400, and 500 may include the contact parts 150, 250, 350, 450, and 550 to easily adjust at least one of the resonance bands. In this case, since at least one of the resonance bands is adjusted according to at least one of the locations and the sizes of the contact parts 150, 250, 350, 450, and 550, spaces between the drive substrates 110, 210, 310, 410, and 510 and the mounting members 170, 270, 370, 470, and 570 can be efficiently used. Accordingly, the resonance frequency bands of the antenna apparatuses 100, 200, 300, 400, and 500 may be adjusted without increasing the sizes of the antenna apparatuses 100, 200, 300, 400, and 500.

Although exemplary embodiments have been described in detail hereinabove, it should be clearly understood that many variations and modifications of the basic inventive concepts herein taught which may appear to those skilled in the present art will still fall within the spirit and scope of the embodiments, as defined in the appended claims.

What is claimed is:

1. An antenna apparatus comprising:

a radiator;

a feeding structure including a feeding unit to provide a signal to the radiator, a ground unit to ground the radiator, and a resonance applying part between the feeding unit and the ground unit; and a contact part to connect the radiator with two out of the three following elements: the feeding unit, the ground unit, and the resonance applying part.

2. The antenna apparatus of claim 1, wherein the contact part adjusts a resonance frequency band determined in the feeding structure according to at least one of a location and a size of the contact part in the feeding structure.

3. The antenna apparatus of claim 2, wherein the contact part comprises:

a first contact unit in the feeding unit; and a second contact unit in one of the ground unit and the resonance applying part.

4. The antenna apparatus of claim 3, wherein the resonance frequency band is adjusted according to an interval between the first contact unit and the second contact unit in the feeding structure.

5. The antenna apparatus of claim 2, wherein the resonance frequency band is adjusted according to a length of the contact part between the radiator and the feeding structure.

6. The antenna apparatus of claim 3, wherein the second contact unit is disposed in the resonance applying part, and the feeding unit and the resonance applying part are open from each other.

7. The antenna apparatus of claim 3, wherein the second contact unit is disposed in the ground unit, and the resonance applying part and the ground unit are open from each other.

8. The antenna apparatus of claim 3, wherein the contact part further comprises a third contact unit disposed in another of the ground unit and the resonance applying part.

9. The antenna apparatus of claim 8, wherein the feeding unit and the resonance applying part are open from each other, and the resonance applying part and the ground unit are open from each other.

10. A feeding structure comprising:

a ground unit;

a feeding unit to feed a signal toward the ground unit;

a resonance applying part between the feeding unit and the ground unit; and a contact part that is in direct physical contact with two out of the three following elements: the feeding unit, the ground unit, and the resonance applying part.

11. The feeding structure of claim 10, wherein the contact part adjusts a resonance frequency band determined in the resonance part and the resonance applying part according to at least one of a location and a size of the contact part.

12. The feeding structure of claim 11, wherein the contact part comprises:

a first contact unit in the feeding unit; and a second contact unit in one of the ground unit and the resonance applying part.

13. The feeding structure of claim 12, wherein the second contact unit is disposed in the resonance applying part, and the feeding unit and the resonance applying part are open from each other, or the second contact unit is disposed in the ground unit, and the resonance applying part and the ground unit are open from each other.

14. The feeding structure of claim 12, wherein the feeding unit and the resonance applying part are open from each other, and the resonance applying part and the ground unit are open from each other.

* * * * *